US009682426B2

(12) United States Patent
Shibayama et al.

(10) Patent No.: US 9,682,426 B2
(45) Date of Patent: Jun. 20, 2017

(54) METHOD FOR PRODUCING FINE SILVER PARTICLES

(71) Applicant: DOWA ELECTRONICS MATERIALS CO., LTD., Tokyo (JP)

(72) Inventors: Tomonori Shibayama, Okayama (JP); Takashi Hinotsu, Okayama (JP); Tatuya Kariyasu, Okayama (JP)

(73) Assignee: Dowa Electronics Materials Co., Ltd., Tokyo (JP)

( * ) Notice: Subject to any disclaimer, the term of this patent is extended or adjusted under 35 U.S.C. 154(b) by 111 days.

(21) Appl. No.: 14/432,516

(22) PCT Filed: Sep. 20, 2013

(86) PCT No.: PCT/JP2013/076449
§ 371 (c)(1),
(2) Date: Mar. 31, 2015

(87) PCT Pub. No.: WO2014/054550
PCT Pub. Date: Apr. 10, 2014

(65) Prior Publication Data

US 2015/0266097 A1 Sep. 24, 2015

(30) Foreign Application Priority Data

Oct. 1, 2012 (JP) ..... 2012-219004

(51) Int. Cl.
*B22F 9/24* (2006.01)
*C22B 11/00* (2006.01)
(Continued)

(52) U.S. Cl.
CPC ..... *B22F 9/24* (2013.01); *C22B 11/04* (2013.01); *C22C 5/06* (2013.01); *H01B 1/02* (2013.01)

(58) Field of Classification Search
None
See application file for complete search history.

(56) References Cited

U.S. PATENT DOCUMENTS 7,648,557 B2 * 1/2010 Irizarry-Rivera ..... B22F 1/0048 75/371
2006/0266156 A1 * 11/2006 Hirakoso ..... B22F 1/0059 75/252

(Continued)

FOREIGN PATENT DOCUMENTS

JP 2010209407 A 9/2010
JP 2012162772 A 8/2012

(Continued)

OTHER PUBLICATIONS

Doruk O. Yener, et al., Synthesis of Nanosized Silver Platelets in Octylamine-Water Bilayer Systems, Langmuir, vol. 18, No. 22, Oct. 2, 2002, pp. 8692-8699, XPO55280086, US.

(Continued)

*Primary Examiner* — George Wyszomierski
(74) *Attorney, Agent, or Firm* — Bachman & LaPointe, PC

(57) ABSTRACT

An aliphatic amine having a carbon number of not less than 6, such as octylamine, hexylamine or oleylamine, serving as an organic protective material is added to water serving as a solvent so that the molar ratio of the aliphatic amine with respect to silver of a silver compound is in the range of 0.05 to 6, a reducing agent, such as hydrazine or $NaBH_4$, being added thereto so that the molar ratio of the reducing agent with respect to silver of the silver compound is in the range of 1 to 6, and the silver compound, such as a silver salt or a silver oxide, being added thereto so that the concentration of silver ions in the aqueous reaction solution is in the range of 0.01 to 1.0 mol/L, and then, the silver compound is reduced at a temperature of 10 to 50° C. to produce fine (Continued)

silver particles having an average primary particle diameter of 10 to 200 nm. Thus, there is provided a method for producing fine silver particles, the method being capable of inexpensively producing fine silver particles in a short time.

9 Claims, 8 Drawing Sheets

(51) Int. Cl.

| | |
|---|---|
| ***C22B 3/00*** | (2006.01) |
| ***C22C 5/06*** | (2006.01) |
| ***H01B 1/02*** | (2006.01) |

(56) References Cited

U.S. PATENT DOCUMENTS

| | | | | |
|---|---|---|---|---|
| 2009/0148600 | A1* | 6/2009 | Li | B22F 1/0022 427/256 |
| 2011/0253949 | A1 | 10/2011 | Kaneda et al. | |
| 2015/0206618 | A1* | 7/2015 | Kozu | B22F 9/24 252/514 |

FOREIGN PATENT DOCUMENTS

| | | | |
|---|---|---|---|
| WO | 2010/036114 | A2 | 4/2010 |
| WO | 2010073420 | A1 | 7/2010 |

OTHER PUBLICATIONS

European Search Report for Application No. 13844412.0 dated Jun. 17, 2016.

* cited by examiner

METHOD FOR PRODUCING FINE SILVER PARTICLES

TECHNICAL FIELD

The present invention relates generally to a method for producing fine silver particles. More specifically, the invention relates to a method for producing fine silver particles used for forming fine circuit patterns of electronic parts and so forth.

BACKGROUND ART

As a conventional method for producing fine silver particles used for forming fine circuit patterns of electronic parts and so forth, there is provided a method for producing silver fine particle powder having an average particle diameter $D_{TEM}$ of 50 nm or less by reducing a silver salt at a temperature of 80 to 200° C. in an alcohol having a boiling point of 80 to 200° C., or a polyol having a boiling point of 150 to 300° C., in the presence of a primary amine having a molecular weight of 100 to 1000 and unsaturated bond(s) serving as an organic protective material as well as a secondary or tertiary amine serving as a reduction supporting agent (see, e.g., Japanese Patent Laid-Open No. 2007-39718).

However, in this method, the reaction time is a long time of 5 to 6 hours, and the alcohol is used as a solvent, so that there is a problem in that the costs thereof are high.

DISCLOSURE OF THE INVENTION

It is therefore an object of the present invention to eliminate the aforementioned problems and to provide a method for producing fine silver particles, the method being capable of inexpensively producing fine silver particles in a short period of time.

In order to accomplish the aforementioned and other objects, the inventors have diligently studied and found that it is possible to inexpensively produce fine silver particles in a short period of time, if an aliphatic amine having a carbon number of not less than 6 serving as an organic protective material, a reducing agent, and a silver compound are added to water serving as a solvent to reduce the silver compound to form fine silver particles. Thus, the inventors have made the present invention.

According the present invention, there is provided a method for producing fine silver particles, the method comprising the steps of: preparing water as a solvent, an aliphatic amine having a carbon number of not less than 6 serving as an organic protective material, a reducing agent, and a silver compound; and adding the aliphatic amine, the reducing agent and the silver compound to the water to carry out a reduction treatment of the silver compound to form fine silver particles.

In this method for producing fine silver particle, the reduction treatment is preferably carried out at a temperature of 10 to 50° C. The aliphatic amine is preferably a water-insoluble aliphatic amine. The aliphatic amine is preferably at least one selected from the group consisting of octylamine, hexylamine and oleylamine. The reducing agent is preferably hydrazine or $NaBH_4$. The fine silver particles preferably have an average primary particle diameter of 10 to 500 nm. The silver compound may be added to the water after the organic protective material and the reducing agent are added thereto. Alternatively, the reducing agent may be added to the water after the organic protective material and the silver compound are added thereto.

Throughout the specification, the expression "water-insoluble" means that the solubility in water is not higher than 0.05 g/l cc.

According to the present invention, it is possible to provide a method for producing fine silver particles, the method being capable of inexpensively producing fine silver particles in a short period of time.

BEST MODE FOR CARRYING OUT THE INVENTION

Figure 1:
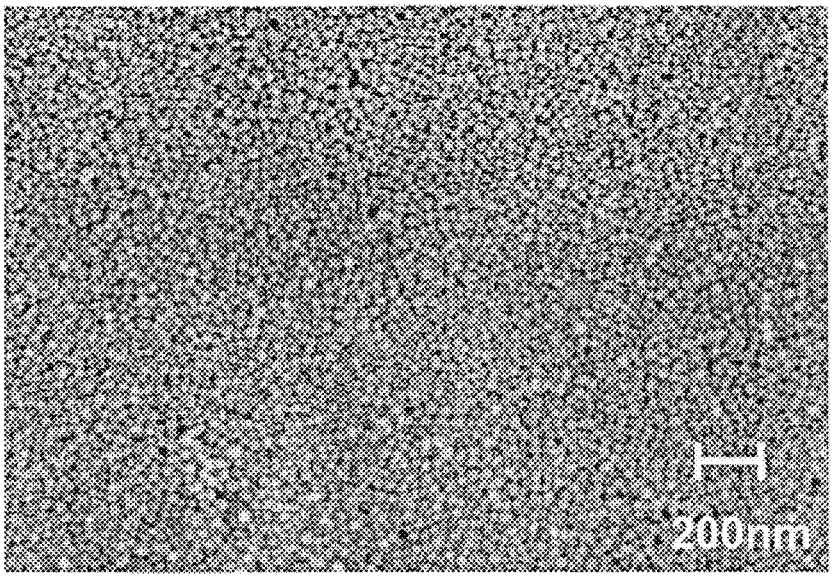
FIG. 1 is a scanning electron micrograph (SEM image) (at a magnification of 50,000) of fine silver particles obtained in Example 1.

In a preferred embodiment of a method for producing fine silver particles according to the present invention, an aliphatic amine having a carbon number of not less than 6 serving as an organic protective material, a reducing agent, and a silver compound are added to water as a solvent to carry out a reduction treatment of the silver compound to form fine silver particles.

The reduction treatment is preferably carried out at a temperature of lower than 60° C., and more preferably carried out at a temperature of 10 to 50° C. When the temperature is not lower than 60° C., the fine silver particles are easily agglutinated to be fusion-bonded to each other so as not to be easily protected with the organic protective material, so that it is not preferable that the temperature is not lower than 60° C. The reaction time in the reduction treatment is preferably not longer than 30 minutes, and more preferably not longer than 10 minutes.

As the organic protective material, an aliphatic amine having a carbon number of not less than 6 is used, and a water-insoluble amine having a solubility in water of not less than 0.05 g/l cc can be used. If an organic protective material having a low solubility in water is used, the organic protective material is not dissolved therein after the fine silver particles are formed. Therefore, it is considered that the organic protective material is difficult to be removed from the fine silver particles, so that the shape of the fine silver particles can be maintained. As such an organic protective material, there can be used at least one selected from the group consisting of hexylamine, heptylamine, octylamine, nonaamine, decaamine, laurylamine, myristylamine, palmitylamine, stearylamine and octadecylamine, as well as oleylamine serving as an unsaturated amine. This organic protective material is preferably added so that the molar ratio thereof to silver of the silver compound is in the range of from 0.05 to 6.

The reducing agent may be any one of various reducing agents capable of reducing silver. However, if the reducing agent is an acidic reducing agent having a carbonyl group, a part of the acidic reducing agent reacts with the organic protective material to amide-bond thereto, although it is possible to obtain fine silver particles. Therefore, the reducing agent is preferably a basic reducing agent, and more preferably hydrazine or $NaBH_4$. This reducing agent is preferably added so that the molar ratio thereof to silver of the silver compound is in the range of from 1 to 6.

The silver compound is preferably a silver salt or a silver oxide, and more preferably silver nitrate. This silver compound is added so that the concentration of silver ions in the aqueous reaction solution is preferably in the range of from 0.01 mol/L to 1.0 mol/L, and more preferably in the range of from 0.03 mol/L to 0.2 mol/L.

The average primary particle diameter of the fine silver particles is preferably in the range of from 10 nm to 500 nm, and more preferably in the range of from 10 nm to 200 nm.

With respect to the addition of the organic protective material, the reducing agent and the silver compound to water, the silver compound may be added to the water after the organic protective material and the reducing agent are added thereto, or the reducing agent may be added to the water after the organic protective material and the silver compound are added thereto. The subsequently added silver compound or reducing agent is preferably added at a stroke in order to shorten the reaction time.

The "average primary particle diameter" of the fine silver particles can be calculated by an image analysis software (A-image-kun (registered trademark) produced by Asahi Kasei Engineering Corporation) with respect to optionally selected 100 or more of fine silver particles on a scanning electron micrograph (SEM image) or transmission electron micrograph (TEM image) obtained by observing the fine silver particles by means of a scanning electron microscope (SEM) (S-4700 produced by Hitachi Hi-Technologies Corporation) or a transmission electron microscope (JEM-1011 produced by Japan Electron Optics Laboratory Ltd.) at a predetermined magnification (a magnification of 180,000 by TEM when the particle diameter is not greater than 20 nm, a magnification of 80,000 by SEM when the particle diameter is greater than 20 nm and not greater than 30 nm, a magnification of 50,000 by SEM when the particle diameter is greater than 30 nm and not greater than 100 nm, a magnification of 30,000 by SEM when the particle diameter is greater than 100 nm and not greater than 300 nm, and a magnification of 10,000 when the particle diameter is greater than 300 nm).

By the preferred embodiment of a method for producing fine silver particles according to the present invention, it is possible to inexpensively produce fine silver particles in a short period of time and to reduce the amount of organic wastes.

Examples of a method for producing fine silver particles according to the present invention will be described below in detail.

EXAMPLE 1

After pure water 3422.0 g serving as a reaction medium was put in a 5 L of reaction vessel to adjust the temperature thereof at 40° C., octylamine (Special Grade produced by Wako Pure Chemical Industries, Ltd., Molecular Weight of 129.24) 51.1 g serving as an organic protective material (the molar ratio of the organic protective material to Ag being 2), and hydrazine hydrate (80% solution produced by Otsuka Chemical Co., Ltd.) 6.2 g serving as a reducing agent (the molar ratio of the reducing agent to Ag being 2) were added thereto, and the solution was stirred by rotating a stirring device having impellers at 345 rpm by means of an outside motor while blowing nitrogen gas serving as an inert gas into the solution at a flow rate of 2 L/min. Then, after an aqueous solution prepared by dissolving silver nitrate crystal (produced by Toyo Kagaku Inc.) 33.6 g serving as a silver compound in pure water 180.0 g was added thereto at a stroke, the solution was stirred for 2 minutes.

Fine silver particles in a slurry thus obtained were observed at a magnification of 50,000 by means of a scanning electron microscope (SEM) (S-4700 produced by Hitachi Hi-Technologies Corporation), and the average primary particle diameter of the fine silver particles was calculated by the image analysis software (A-image-kun (registered trademark) produced by Asahi Kasei Engineering Corporation) with respect to optionally selected 100 or more of fine silver particles on the SEM image. As a result, the average primary particle diameter was 35.6 nm.

EXAMPLE 2

Fine silver particles were produced by the same method as that in Example 1, except that hexylamine (insoluble, the solubility in water being 0.012 g/cc) (Special Grade produced by Wako Pure Chemical Industries, Ltd.) 39.6 g (the molar ratio of the organic protective material to Ag being 2) was used as the organic protective material in place of octylamine, and the average primary particle diameter of the fine silver particles was calculated by the same method as that in Example 1. As a result, the average primary particle diameter was 32.1 nm.

EXAMPLE 3

Fine silver particles were produced by the same method as that in Example 1, except that oleylamine (Special Grade produced by Wako Pure Chemical Industries, Ltd.) 10.6 g (the molar ratio of the organic protective material to Ag being 0.2) was used as the organic protective material in place of octylamine, and the average primary particle diameter of the fine silver particles was calculated by the same method as that in Example 1. As a result, the average primary particle diameter was 129.7 nm.

EXAMPLE 4

Fine silver particles were produced by the same method as that in Example 3, except that an aqueous solution, which was prepared by dissolving $NaBH_4$ (Special Grade produced by Wako Pure Chemical Industries, Ltd.) 2.8 g (the molar ratio of the reducing agent to Ag being 1.5) in an aqueous solution 20.6 g containing 40 wt % of NaOH, was used in place of hydrazine hydrate serving as the reducing agent and that a process sequence, in which the reducing agent was added at a stroke after the organic protective material and the silver compound were added, was used in place of the process sequence in which a solution of the silver compound was added in a stroke after the organic protective material and the reducing agent were added, and the average primary particle diameter of the fine silver particles was calculated by the same method as that in Example 1. As a result, the average primary particle diameter was 24.3 nm.

EXAMPLE 5

Fine silver particles were produced by the same method as that in Example 1, except that the amount of octylamine added as the organic protective material was 63.8 g (the molar ratio of the organic protective material to Ag being 2.5), and the average primary particle diameter of the fine silver particles was calculated by the same method as that in Example 1. As a result, the average primary particle diameter was 41.5 nm.

EXAMPLE 6

Fine silver particles were produced by the same method as that in Example 1, except that the amount of octylamine added as the organic protective material was 102.1 g (the molar ratio of the organic protective material to Ag being 4), and the average primary particle diameter of the fine silver particles was calculated by the same method as that in Example 1. As a result, the average primary particle diameter was 34.9 nm.

EXAMPLE 7

Fine silver particles were produced by the same method as that in Example 1, except that the amount of hydrazine hydrate added as the reducing agent was 15.0 g (the molar ratio of the reducing agent to Ag being 4.84), and the average primary particle diameter of the fine silver particles was calculated by the same method as that in Example 1. As a result, the average primary particle diameter was 76.6 nm.

EXAMPLE 8

Fine silver particles were produced by the same method as that in Example 1, except that the temperature of the reaction medium was 50° C., and the average primary particle diameter of the fine silver particles was calculated by the same method as that in Example 1. As a result, the average primary particle diameter was 59.0 nm.

EXAMPLE 9

Fine silver particles were produced by the same method as that in Example 1, except that the temperature of the reaction medium was 30° C., and the average primary particle diameter of the fine silver particles was calculated by the same method as that in Example 1. As a result, the average primary particle diameter was 41.5 nm.

EXAMPLE 10

Fine silver particles were produced by the same method as that in Example 1, except that the temperature of the reaction medium was 10° C., and the average primary particle diameter of the fine silver particles was calculated by the same method as that in Example 1. As a result, the average primary particle diameter was 49.9 nm.

EXAMPLE 11

Fine silver particles were produced by the same method as that in Example 1, except that a process sequence, in which the reducing agent was added at a stroke after the organic protective material and the silver compound were added, was used in place of the process sequence in which a solution of the silver compound was added in a stroke after the organic protective material and the reducing agent were added, and the average primary particle diameter of the fine silver particles was calculated by the same method as that in Example 1. As a result, the average primary particle diameter was 51.9 nm.

COMPARATIVE EXAMPLE 1

Oleylamine (produced by Wako Pure Chemical Industries, Ltd., Molecular Weight of 267) 153.4 mL serving as an organic protective material, and silver nitrate crystal 19.2 g serving as a silver compound were added to isobutanol (Special Grade produced by Wako Pure Chemical Industries, Ltd.) 112.3 g serving as a reaction medium and reducing agent to be stirred by a magnetic stirrer to dissolve silver nitrate therein.

Then, this solution was put in a vessel with reflux condenser. This vessel was put on an oil bath to be heated to 100° C., at a temperature rising rate of 2° C./min while blowing nitrogen gas serving as an inert gas into the vessel at a low rate of 400 mL/min and while stirring the solution at a rotating speed of 100 rpm by means of a magnet stirrer.

After the solution was refluxed at 100° C. for 5 hours, diethanolamine being a secondary amine (produced by Wako Pure Chemical Industries, Ltd. , Molecular Weight of 105.64) 12.0 g (the molar ratio of the reducing agent to Ag being 1.0) was added thereto as a reduction supporting agent to hold it for 1 hour to complete the reaction.

Fine silver particles thus obtained were observed at a magnification of 60,000 by means of a transmission electron microscope (JEM-1011 produced by Japan Electron Optics Laboratory Ltd.). The obtained TEM image was enlarged three times by means of an enlarger (SD690 Professional produced by Fujifilm Corporation) so that the magnification was 180,000. With respect to optionally selected 100 or more of fine silver particles on the enlarged TEM image, the average primary particle diameter of the fine silver particles was calculated by the image analysis software (A-image-kun (registered trademark) produced by Asahi Kasei Engineering Corporation). As a result, the average primary particle diameter was 8.9 nm.

COMPARATIVE EXAMPLE 2

Fine silver particles were produced by the same method as that in Example 1, except that cyclohexylamine (Special Grade produced by Wako Pure Chemical Industries, Ltd.) 39.2 g (the molar ratio of the organic protective material to Ag being 2) was used as the organic protective material in place of octylamine. The fine silver particles thus obtained were observed in order to calculate the average primary particle diameter thereof. As a result, it was observed that the fine silver particles were agglutinated with each other to form an agglutinated powder.

COMPARATIVE EXAMPLE 3

Fine silver particles were produced by the same method as that in Example 1, except that butylamine (Special Grade produced by Wako Pure Chemical Industries, Ltd.) 28.9 g (the molar ratio of the organic protective material to Ag being 2) was used as the organic protective material in place of octylamine. The fine silver particles thus obtained were observed in order to calculate the average primary particle diameter thereof. As a result, it was observed that the fine silver particles were agglutinated with each other to form an agglutinated powder.

COMPARATIVE EXAMPLE 4

Fine silver particles were produced by the same method as that in Example 1, except that the temperature of the reaction medium was 60° C. The fine silver particles thus obtained were observed in order to calculate the average primary particle diameter thereof. As a result, it was observed that the fine silver particles were agglutinated with each other to form an agglutinated powder.

Figure 2:
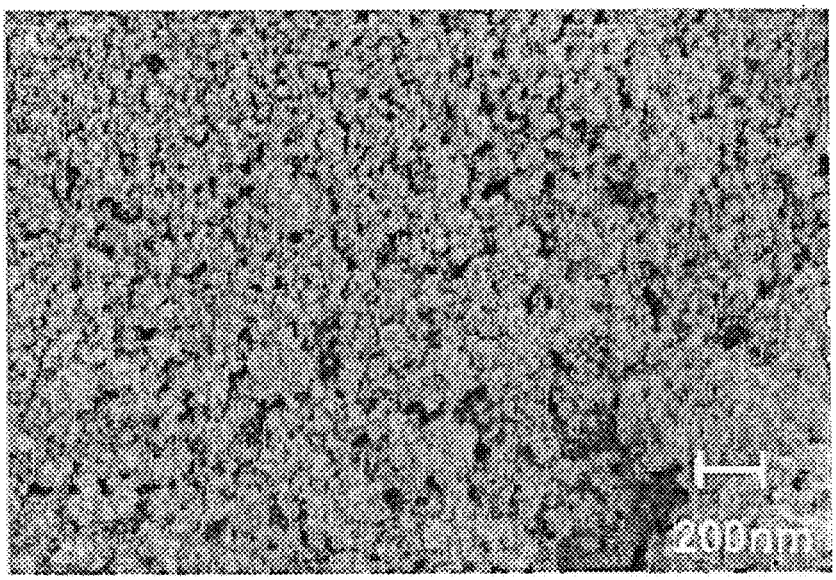
FIG. 2 is a SEM image (at a magnification of 50,000) of fine silver particles obtained in Example 2.
Figure 3:
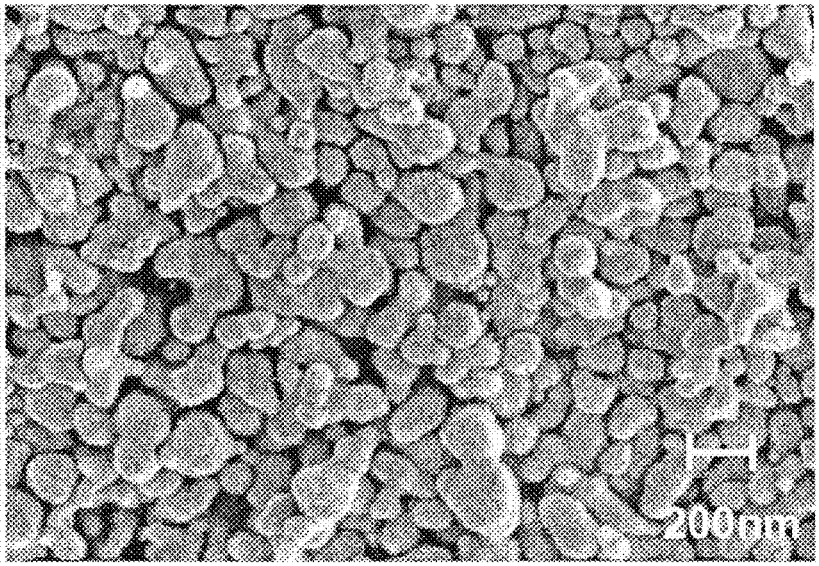
FIG. 3 is a SEM image (at a magnification of 50,000) of fine silver particles obtained in Example 3.
Figure 4:
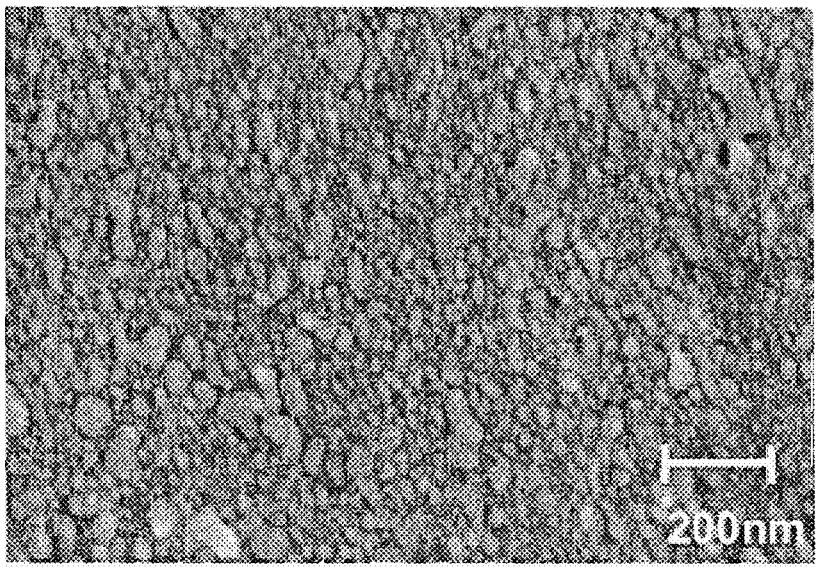
FIG. 4 is a SEM image (at a magnification of 80,000) of fine silver particles obtained in Example 4.
Figure 5:
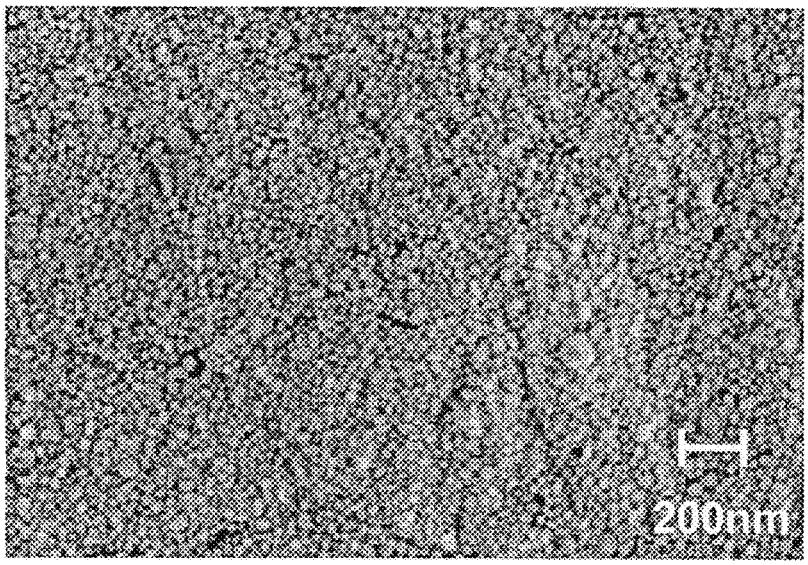
FIG. 5 is a SEM image (at a magnification of 50,000) of fine silver particles obtained in Example 5.
Figure 6:
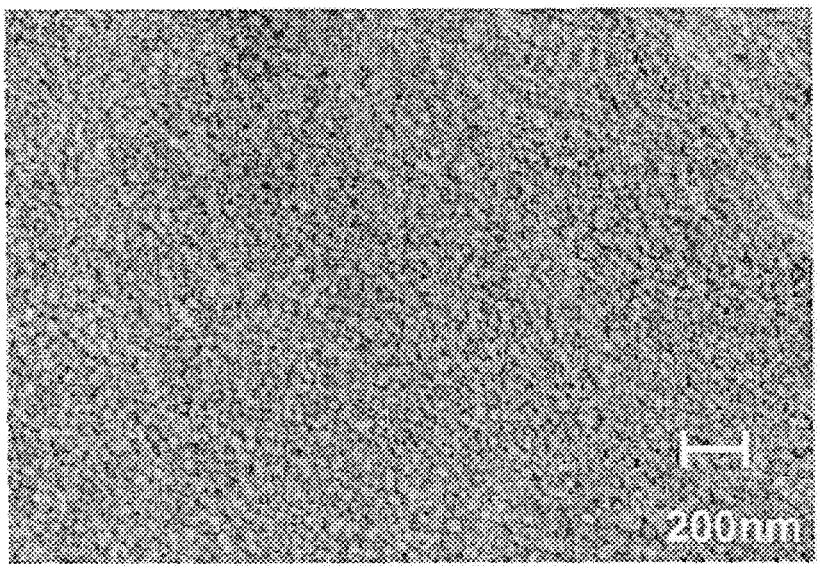
FIG. 6 is a SEM image (at a magnification of 50,000) of fine silver particles obtained in Example 6.
Figure 7:
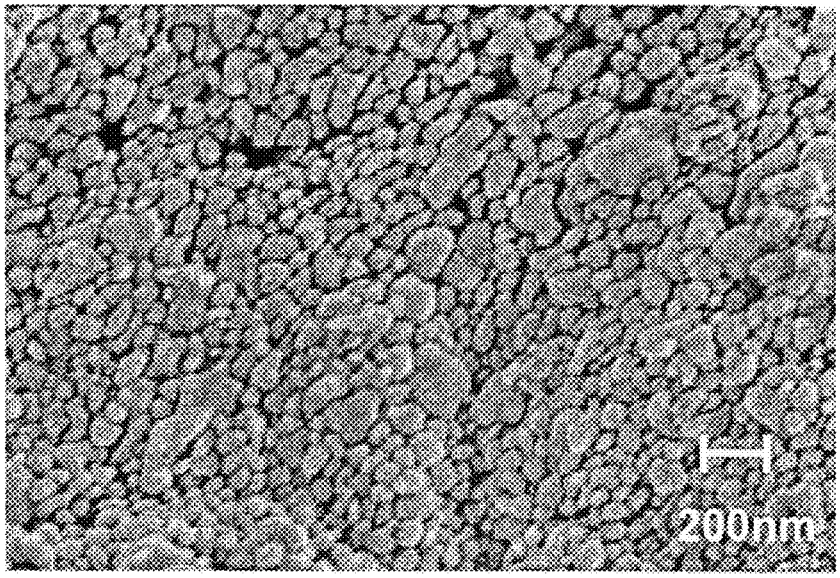
FIG. 7 is a SEM image (at a magnification of 50,000) of fine silver particles obtained in Example 7.
Figure 8:
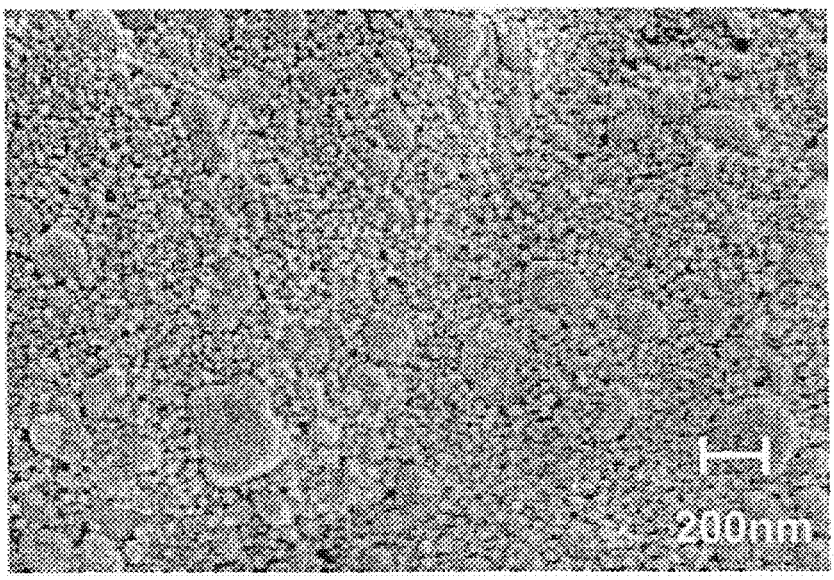
FIG. 8 is a SEM image (at a magnification of 50,000) of fine silver particles obtained in Example 8.
Figure 9:
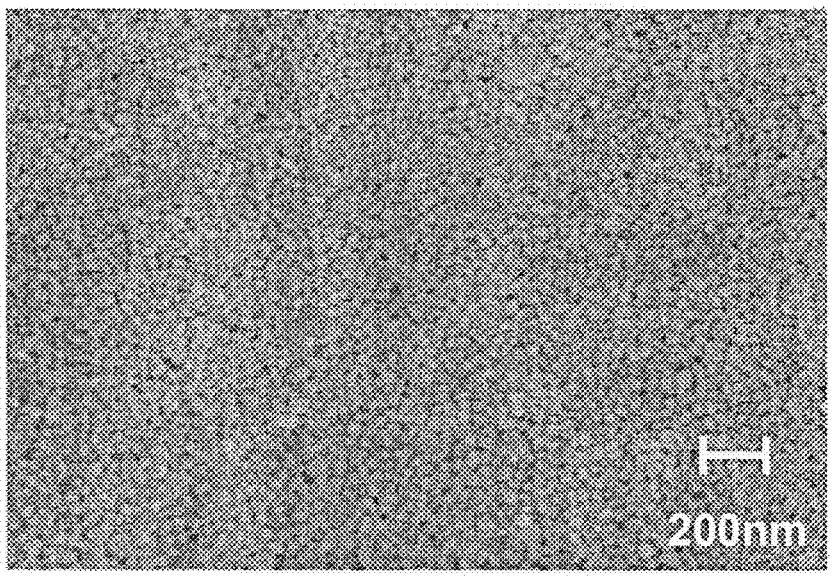
FIG. 9 is a SEM image (at a magnification of 50,000) of fine silver particles obtained in Example 9.
Figure 10:
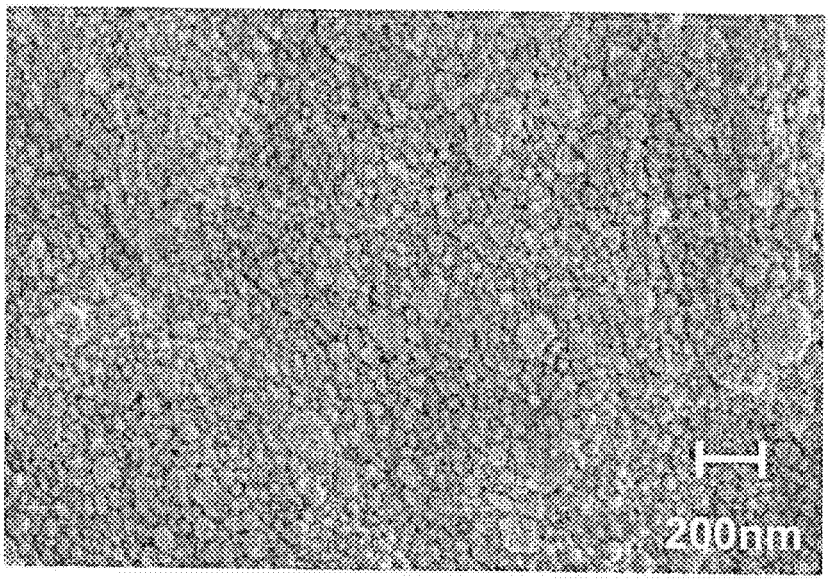
FIG. 10 is a SEM image (at a magnification of 50,000) of fine silver particles obtained in Example 10.
Figure 11:
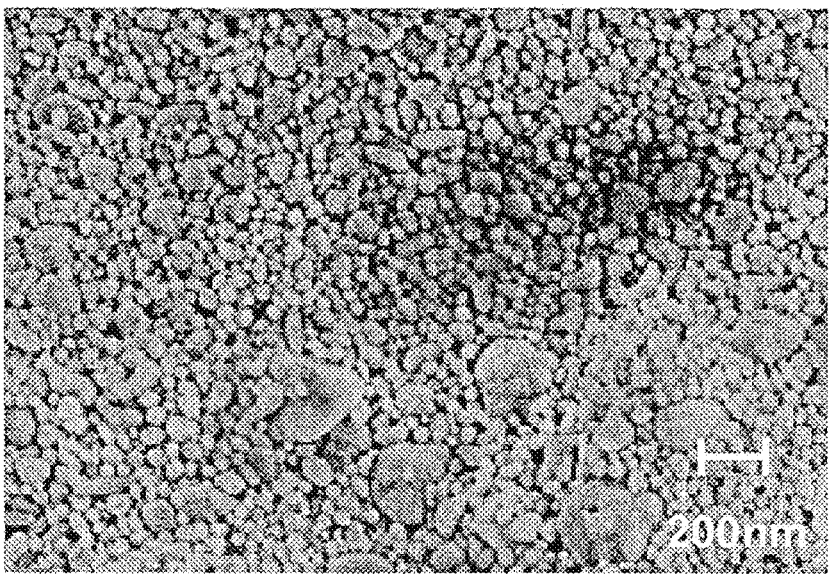
FIG. 11 is a SEM image (at a magnification of 50,000) of fine silver particles obtained in Example 11.
Figure 12:
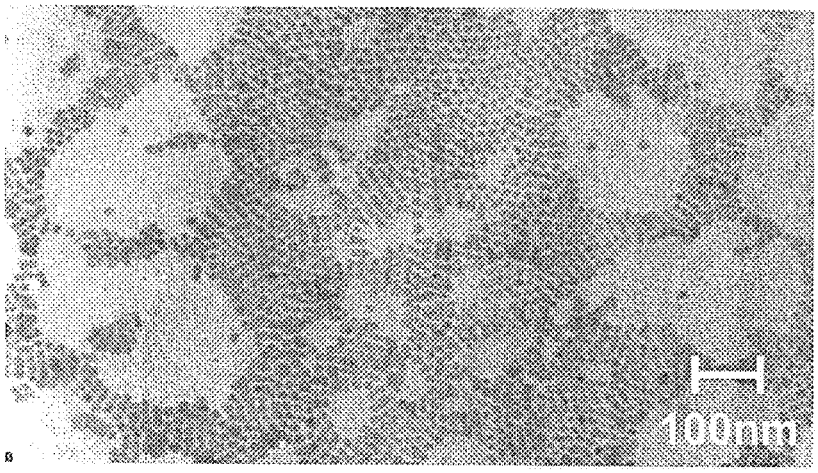
FIG. 12 is a transmission electron micrograph (TEM image) (at a magnification of 180,000) of fine silver particles obtained in Comparative Example 1.
Figure 13:
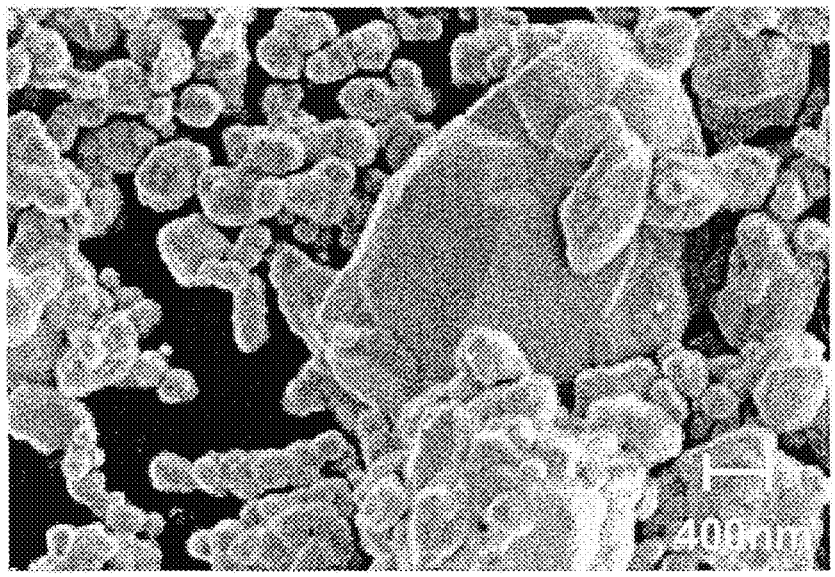
FIG. 13 is a SEM image (at a magnification of 30,000) of fine silver particles obtained in Comparative Example 2.
Figure 14:
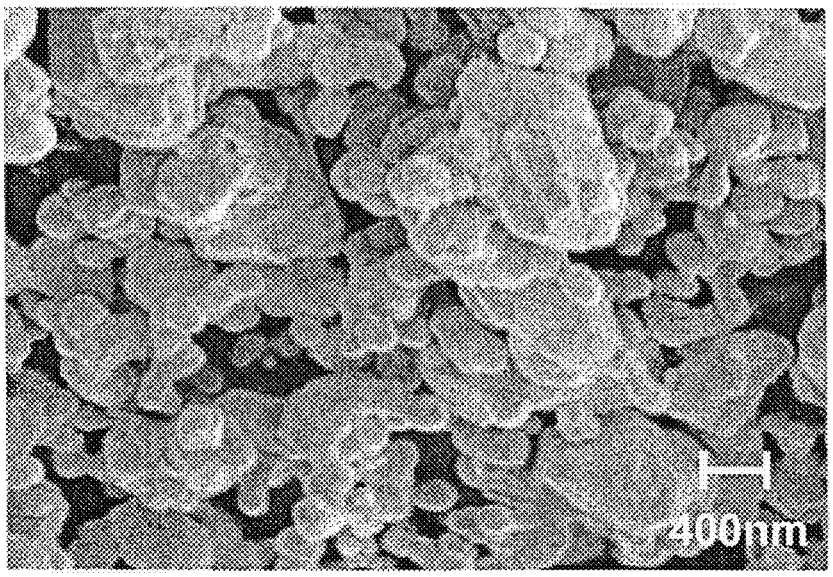
FIG. 14 is a SEM image (at a magnification of 30,000) of fine silver particles obtained in Comparative Example 3.
Figure 15:
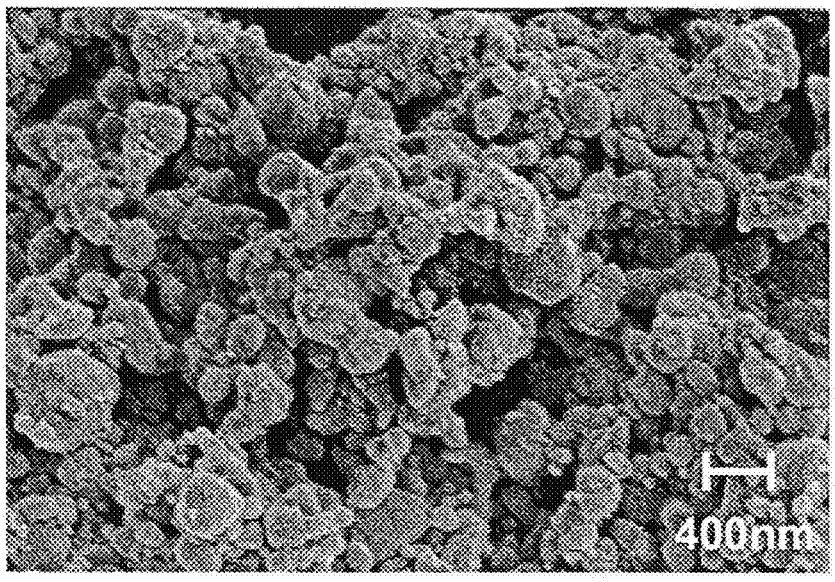
FIG. 15 is a SEM image (at a magnification of 30,000) of fine silver particles obtained in Comparative Example 4.

The producing conditions and characteristics of the fine silver particles produced in these examples and comparative examples are shown in Tables 1 and 2, and the scanning electron micrographs (SEMS) of the fine silver particles are shown in FIGS. 1 through 15.

TABLE 1

| | | Reducing Agent | | Organic Protective Material | | | |
|---|---|---|---|---|---|---|---|
| | Solvent | Type | Equivalent | Type | Carbon No. | Solubility to water | Equivalent |
| Ex. 1 | water | hydrazine hydrate | 2 | octyl amine | C8 | insoluble | 2 |
| Ex. 2 | water | hyrdazine hydrate | 2 | hexyl amine | C6 | slightly soluble | 2 |
| Ex. 3 | water | hyrdazine hydrate | 2 | oleyl amine | C18 | insoluble | 0.2 |
| Ex. 4 | water | $NaBH_4$ | 1.5 | oleyl amine | C18 | insoluble | 0.2 |
| Ex. 5 | water | hyrdazine hydrate | 2 | octyl amine | C8 | insoluble | 2.5 |
| Ex. 6 | water | hyrdazine hydrate | 2 | octyl amine | C8 | insoluble | 4 |
| Ex. 7 | water | hyrdazine hydrate | 4.8 | octyl amine | C8 | insoluble | 2 |
| Ex. 8 | water | hyrdazine hydrate | 2 | octyl amine | C8 | insoluble | 2 |
| Ex. 9 | water | hyrdazine hydrate | 2 | octyl amine | C8 | insoluble | 2 |
| Ex. 10 | water | hyrdazine hydrate | 2 | octyl amine | C8 | insoluble | 2 |
| Ex. 11 | water | hyrdazine hydrate | 2 | octyl amine | C8 | insoluble | 2 |
| Comp. 1 | isobutanol | Isobutanol + diethanol amine | 13.4 + 1 | oleyl amine | C18 | insoluble | 5 |
| Comp. 2 | water | hyrdazine hydrate | 2 | cyclo hexyl amine | C6 | easily soluble | 2 |
| Comp. 3 | water | hyrdazine hydrate | 2 | butyl amine | C4 | easily soluble | 2 |
| Comp. 4 | water | hyrdazine hydrate | 2 | octyl amine | C8 | insoluble | 2 |

TABLE 2

| | Reaction Temp. (° C.) | Reaction Time (min) | Average Primary Particle Diameter (nm) |
|---|---|---|---|
| Ex. 1 | 40 | 2 | 35.6 |
| Ex. 2 | 40 | 2 | 32.1 |
| Ex. 3 | 40 | 2 | 129.7 |
| Ex. 4 | 40 | 2 | 24.3 |
| Ex. 5 | 40 | 2 | 41.5 |
| Ex. 6 | 40 | 2 | 34.9 |
| Ex. 7 | 40 | 2 | 76.6 |
| Ex. 8 | 50 | 2 | 59.0 |
| Ex. 9 | 30 | 2 | 41.5 |
| Ex. 10 | 10 | 2 | 49.9 |
| Ex. 11 | 40 | 2 | 51.9 |
| Comp. 1 | 100 | 360 | 8.9 |
| Comp. 2 | 40 | 2 | — |
| Comp. 3 | 40 | 2 | — |
| Comp. 4 | 60 | 2 | — |

As can be seen from Tables 1 and 2, in Examples 1 through 11, an aliphatic amine having a carbon number of not less than 6, such as octylamine, hexylamine or oleylamine, serving as an organic protective material, a reducing agent, such as hydrazine or $NaBH_4$, and a silver compound, such as a silver salt or a silver oxide, are added to water as a solvent to reduce the silver compound at a temperature of 10 to 50° C., so that it is possible to inexpensively produce fine silver particles having an average primary particle diameter of 20 to 130 nm in a short period of time. In Examples 1 through 11, it is also possible to dramatically shorten the reaction time at a lower reaction temperature in comparison with Comparative Example 1. If an easily water-soluble organic protective material having a high solubility in water is used as Comparative Example 2, the organic protective material is dissolved during the reaction, so that fine silver particles are agglutinated with each other to form an agglutinated powder. Moreover, if the temperature of the reaction is a high temperature of 60° C., as Comparative Example 4, fine silver particles are agglutinated with each other to form an agglutinated powder.

A method for producing fine silver particles according to the present invention can be used for producing fine silver particles used for forming fine circuit patterns of electronic parts, reflection coatings, bonded articles, electrodes, plated products, and so forth.

The invention claimed is:

1. A method for producing fine silver particles, the method comprising the steps of:

preparing water as a solvent, an aliphatic amine having a carbon number of not less than 6 serving as an organic protective material, a reducing agent, and a silver compound; and adding the aliphatic amine, the reducing agent and the silver compound to the water to carry out a reduction treatment of the silver compound for a reduction time of not longer than 30 minutes to form fine silver particles.

2. A method for producing fine silver particles as set forth in claim 1, wherein said reduction treatment is carried out at a temperature of 10 to 50° C.

3. A method for producing fine silver particles as set forth in claim 1, wherein said aliphatic amine is a water-insoluble aliphatic amine.

4. A method for producing fine silver particles as set forth in claim 1, wherein said aliphatic amine is at least one selected from the group consisting of octylamine, hexylamine and oleylamine.

5. A method for producing fine silver particles as set forth in claim 1, wherein said reducing agent is hydrazine or $NaBH_4$.

6. A method for producing fine silver particles as set forth in claim 1, wherein said fine silver particles have an average primary particle diameter of 10 to 500 nm.

7. A method for producing fine silver particles as set forth in claim 1, wherein said silver compound is added to said water after said organic protective material and said reducing agent are added thereto.

8. A method for producing fine silver particles as set forth in claim 1, wherein said reducing agent is added to said water after said organic protective material and said silver compound are added thereto.

9. A method for producing fine silver particles as set forth in claim 1, wherein said reduction time is not longer than 10 minutes.

* * * * *